US011518416B2

(12) United States Patent
Malik

(10) Patent No.: US 11,518,416 B2
(45) Date of Patent: Dec. 6, 2022

(54) NON-STOP TRAIN WITH ATTACHING AND DETACHING TRAIN CARS

(71) Applicant: Mohd B. Malik, Old Lyme, CT (US)

(72) Inventor: Mohd B. Malik, Old Lyme, CT (US)

( * ) Notice: Subject to any disclaimer, the term of this patent is extended or adjusted under 35 U.S.C. 154(b) by 888 days.

(21) Appl. No.: 16/401,560

(22) Filed: May 2, 2019

(65) Prior Publication Data

US 2020/0055526 A1 Feb. 20, 2020

Related U.S. Application Data

(63) Continuation-in-part of application No. 16/105,457, filed on Aug. 20, 2018, now Pat. No. 10,919,548.

(51) Int. Cl.

| | |
|---|---|
| ***B61B 1/00*** | (2006.01) |
| ***B61B 1/02*** | (2006.01) |
| ***B61L 25/02*** | (2006.01) |
| ***B61G 3/20*** | (2006.01) |
| ***B61G 7/00*** | (2006.01) |
| ***B61D 41/00*** | (2006.01) |
| ***B61L 27/16*** | (2022.01) |
| ***B61L 27/40*** | (2022.01) |

(52) U.S. Cl.

CPC ..... *B61B 1/005* (2013.01); *B61B 1/02* (2013.01); *B61D 41/00* (2013.01); *B61G 3/20* (2013.01); *B61G 7/00* (2013.01); *B61L 25/021* (2013.01); *B61L 25/028* (2013.01); *B61L 27/16* (2022.01); *B61L 27/40* (2022.01)

(58) Field of Classification Search

CPC ..... B61B 1/005; B61B 1/02; B61D 41/00; B61G 3/20; B61G 7/00; B61L 25/021; B61L 25/028; B61L 25/025; B61L 27/16; B61L 27/40; B61L 27/04; B61L 15/0027; B61L 15/009; B61L 15/0072; B61L 3/006; B61L 21/10; B61K 1/00

See application file for complete search history.

(56) References Cited

U.S. PATENT DOCUMENTS

| | | | | |
|---|---|---|---|---|
| 3,848,533 | A * | 11/1974 | Grow | B61K 1/00 104/18 |
| 2013/0196519 | A1* | 8/2013 | Krause | H04B 5/0031 439/34 |
| 2018/0079436 | A1* | 3/2018 | Fifield | B61L 27/40 |
| 2019/0054929 | A1* | 2/2019 | Yao | B61G 1/00 |

* cited by examiner

*Primary Examiner* — Russell Frejd

(74) *Attorney, Agent, or Firm* — Kilyk & Bowersox, P.L.L.C.

(57) ABSTRACT

A non-stop train system including a plurality of train cars in communication with one another and in communication with an electronic control module. The train system includes a track or any number of parallel tracks having a plurality of drop off and pick up locations. A prepositioned train car is stopped at one of the drop off and pick up locations. A non-stop express train approaches and passes by the drop off and pick up location on the track initiating the prepositioned train car to begin departure. The electronic control module is used to adjust the speed of the non-stop express train and the prepositioned train car based on a detected distance such that a rear coupler of the non-stop express train couples to the front coupler of the prepositioned train car while moving along the track.

14 Claims, 16 Drawing Sheets

Prior Art

* Distance sensors can be any or all of the following: Radio Frequency (Radar), Sound (Sonar), Ultrasonic, Visual (Cameras, Computer Generated Images, Digital Graphical Inputs).

NON-STOP TRAIN WITH ATTACHING AND DETACHING TRAIN CARS

CROSS-REFERENCE TO RELATED APPLICATION

This application is a continuation-in-part of U.S. non-provisional application Ser. No. 16/105,457, filed Aug. 20, 2018, the contents of which are herein incorporated by reference.

BACKGROUND OF THE INVENTION

The present invention relates to a train system and, more particularly, to a non-stop, short and long-distance express train system with attaching and detaching train cars for unloading and loading passengers.

Currently, the method for operating short and long-distance trains and mass transit rail systems is for a train to stop at each pre-existing station along a predetermined route to board and discharge passengers. The slowing down, stopping and waiting at each pre-existing station and then accelerating away from each station consume a lot of time, energy and reduce the efficiency of the overall operating system.

Many methods have been proposed and even incorporated to try and reduce the delays caused by this outmoded method of operation, such as electronic ticketing, adding more trains, reducing the number of stops during rush hour periods and reducing the time at each stop. None of these approaches meet the often-conflicting goals of improving service, reducing wait times, decreasing operating and maintenance costs while increasing the average train speed to get riders where they want to go as quickly as possible.

Recent developments in short and long-distance train travel and mass transit art include trains running in vacuum conditions inside sealed tunnels to increase travel speeds. These tunnels are dug by special boring machines that operate without disturbing surface or sub-surface infrastructure. Another proposal is to install monorail systems along highway routes to reduce new transit line construction costs. A Chinese mass transit train design proposal has train cars with detachable passenger cars above the main cars. The passenger cars detach and travel on a separate set of tracks to each station and then return to the main track to reattach to the main cars. All these ideas are novel and are certainly within the realm of possibilities, but are enormously costly to implement.

These expensive improvements aside, the current short and long-distance trains and mass transit art has not kept pace with the need for faster service and more convenient schedules for the current ridership. It has also not sought to have well-equipped train cars with toilets, cafes or wireless internet access that is demanded by passengers of rail transit systems in the present day. These and other conveniences are required to retain the present ridership and to attract new ridership in an era where the trend is to ride-share, use a smart phone to summon call-for-hire rides and, in general, avoid vehicle ownership. As an example of this shortsightedness in the current art, rapid transit and short and long-distance rail cars currently in service or being ordered by large mass transit systems and regional or nationwide rail operators do not have any provision for these features or amenities. However, they must be considered necessary in today's convenience-driven and technology-driven environment.

The San Francisco Bay Area Rapid Transit (BART) system and the Los Angeles and Washington D.C. Metro systems are modern and provide relatively comfortable service. However, they could be improved by offering higher average travel speed and more frequent arrival and departure schedules. There are other urban city mass transit systems in the United States that are still using outmoded and/or decaying rail cars and are not catering to the needs of their ridership in either conveniences or travel schedules. Known plans of the New York City Metropolitan Transportation Authority (MTA) to replace existing rail cars with new R211 rail cars are still circumscribed by use of the current, outdated and inflexible operating system that has not changed in its basic operational methods in over 100 years of service. Short and long-distance rail systems continue to use similarly restrictive and outmoded methods to provide rail service to a shrinking portion of the population that still uses trains to travel between large metropolitan centers, mainly along the Eastern portion of the United States.

As can be seen, there is a need for a train system with higher average train speeds, convenient schedules to suit the ridership, decreased operating costs with less wear and tear on the equipment, and the incorporation of various amenities on the rail cars to make short and long-distance train travel and rapid transit via rail more enjoyable for the ridership with a minimal required capital investment in equipment.

SUMMARY OF THE INVENTION

In one aspect of the present invention, a non-stop train system comprises: a plurality of train cars each comprising: a braking system coupled to rail wheels; an operator's cab comprising controllers; a front coupler and a rear coupler; a proximity sensor; and a wireless transmitter and receiver, an electronic control module communicatively coupled to the proximity sensor via the wireless transmitter and receiver and comprising a processor and a memory, and at least one main track and a plurality of stop tracks connected to the at least one main track, wherein each of the plurality of stop tracks are a drop off and pick up location, wherein at least one prepositioned train car of the plurality of train cars is stopped on one of the plurality of stop tracks, at least one non-stop express train car of the plurality of train cars approaches and passes the one of the plurality of stop tracks along the main track, wherein the at least one prepositioned train car departs from the one of the plurality of stop tracks, the at least one prepositioned train car accelerates onto the main track from the at least one of the plurality of stop tracks approaching a rear of the at least one non-stop express train car, the sensors detect a distance and a relative speed between the at least one non-stop express train car and the at least one prepositioned train car, and the electronic control module adjusts the speed of the at least one non-stop express train car and the at least one prepositioned train car based on the detected distance such that the rear coupler of the at least one non-stop express train car couples to the front coupler of the at least one prepositioned train car while moving along the track.

In another aspect of the present invention, a non-stop train system comprises: a plurality of train cars each comprising: a braking system coupled to rail wheels; an operator's cab comprising controllers; a display disposed within the operator's cab; a front coupler and a rear coupler; a proximity sensor; and a wireless transceiver; an electronic control module communicatively coupled to the proximity sensor and the display via the wireless transceiver, and comprising a processor and a memory, and at least one main track and a plurality of stop tracks connected to the at least one main track, wherein each of the plurality of stop tracks are a drop off and pick up location, wherein at least one prepositioned train car of the plurality of train cars is stopped on one of the plurality of stop tracks, at least one non-stop express train car of the plurality of train cars approaches and passes the one of the plurality of stop tracks along the main track, wherein the at least one prepositioned train car departs from the one of the plurality of stop tracks, the at least one prepositioned train car accelerates onto the main track from the at least one of the plurality of stop tracks approaching a rear of the at least one non-stop express train car, the sensors detect a distance and a relative speed between the at least one non-stop express train car and the at least one prepositioned train car, and the electronic control module processes inputs of the proximity sensors and outputs data comprising the distance and the relative speed between the at least one non-stop express train car and the at least one prepositioned train car on the display to facilitate the coupling of the rear coupler of the at least one non-stop express train car to the front coupler of the at least one prepositioned train car while moving along the main track.

These and other features, aspects and advantages of the present invention will become better understood with reference to the following drawings, description and claims.

DETAILED DESCRIPTION OF THE INVENTION

Figure 1:
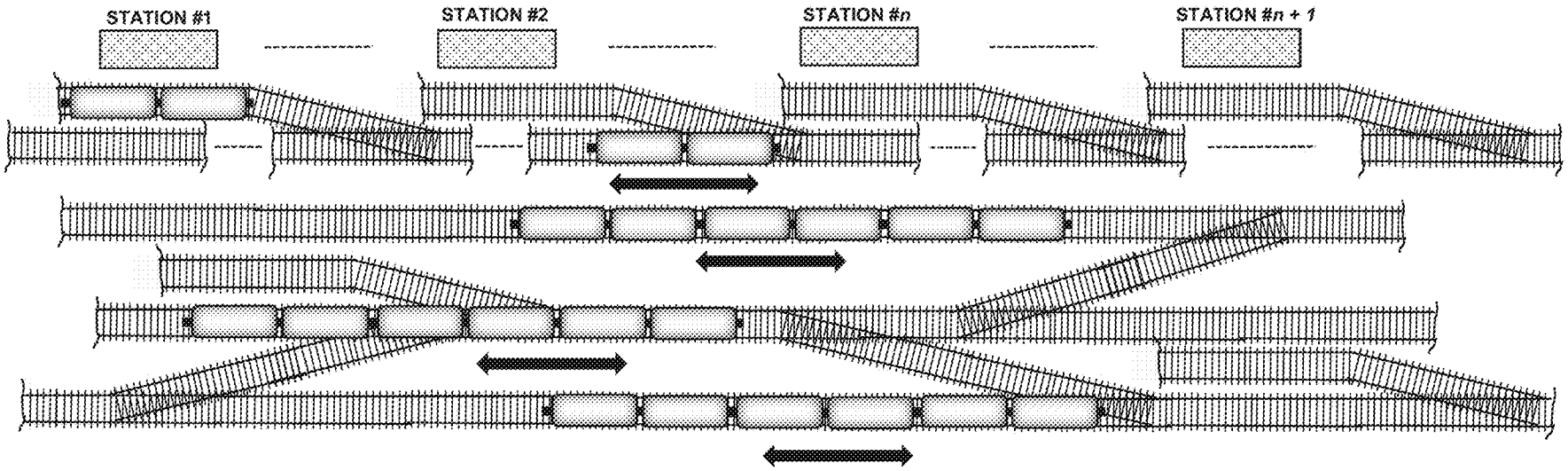
FIG. 1 is a schematic diagram in plan view of a typical short and long-distance train track system with a plurality of parallel tracks for trains to use in either direction with typical station stops along the route.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention encompasses autonomous, self-driving or manually operated, self-propelled, short and long-distance non-stop express trains carrying passengers, cargo, baggage, or any combination of these items, that travel on single or an unlimited number or series of parallel train tracks or a similar predetermined route with multiple, train cars that attach and detach at the rear of the short and long-distance non-stop express train.

Attachment and detachment of the train cars may be by way of the standard Scharfenberg coupler or a coupler of a similar nature or any type of a coupling mechanism that allows for these connections to be made and unmade while the short and long-distance non-stop express trains and individual train cars are underway. A coupling proximity sensor suite system, added as part of the present invention, is used to provide all of the operational enhancements required to put the present invention into operation. The coupling proximity sensor suite system is designed to be modularized such that it can easily be retrofitted to either existing train cars or can be incorporated into new cars under construction.

Individual train cars are prepositioned at either existing stations or at any location along the route on the same track or on an unlimited number or series of parallel tracks and then leave each stop or station after the short and long-distance non-stop express train has passed by. Trailing car of the short and long-distance non-stop express train couples underway with the coupling mechanism at the front of the prepositioned train car or cars that just left the station after the short and long-distance non-stop express train has previously passed by. Subsequent to this operation, passengers on the now attached rear train car can move from this car or cars into other cars of the short and long-distance non-stop express train depending on whether they are disembarking from the short and long-distance non-stop express train at the next stop. At the same time, with appropriate visual, audible and other instructions, the passengers that plan to get off at the next stop move to the last car or cars of the short and long-distance non-stop express train. At the appropriate time, the last car or cars of the short and long-distance non-stop express train detach from the short and long-distance non-stop express train and that detached train car or cars slow down and stop at the next station along the route.

Coupling and decoupling control of the train cars in the short and long-distance non-stop express train is via the master key, master token, master code card or some other similar device that is part of the coupling proximity sensor suite system.

Passengers wait safely inside the previously prepositioned train car or cars at each station or location out of the weather and environmentally comfortable until the train car or cars leaves the station or location after the next short and long-distance non-stop express train has passed by that station or location. These prepositioned cars are cleaned, amenities, such as water, snacks, beverages are restocked and batteries, if used, are recharged while waiting.

Passengers already on the short and long-distance non-stop express train that are getting off at the next station or location stop are instructed by audio and visual signals as well as the conductor-operator to move to the rear car or cars of the short and long-distance non-stop express train prior to the access doors closing and that train car or cars then detaches and stops at the next station or location stop.

The short and long-distance non-stop express train and individual train cars are self-propelled and either controlled by a human operator with computer assistance or are automatically controlled by computer mechanisms that interface with the coupling proximity sensor suite system.

FIG. 1 depicts a typical train multiple parallel track system for train operations that uses one or more tracks for routing of train cars and has multiple stations, along the track. Stations are shown along the route of each track to allow for embarking and disembarking of passengers. Typically, in the art, trains run on each parallel track in either direction and generally stop at each station for passengers along the entire length of that particular route and then either follow a loop to turn around to head back using another parallel track or use switching mechanisms to turn onto other track systems that interconnect with the current track system.

Figure 2:
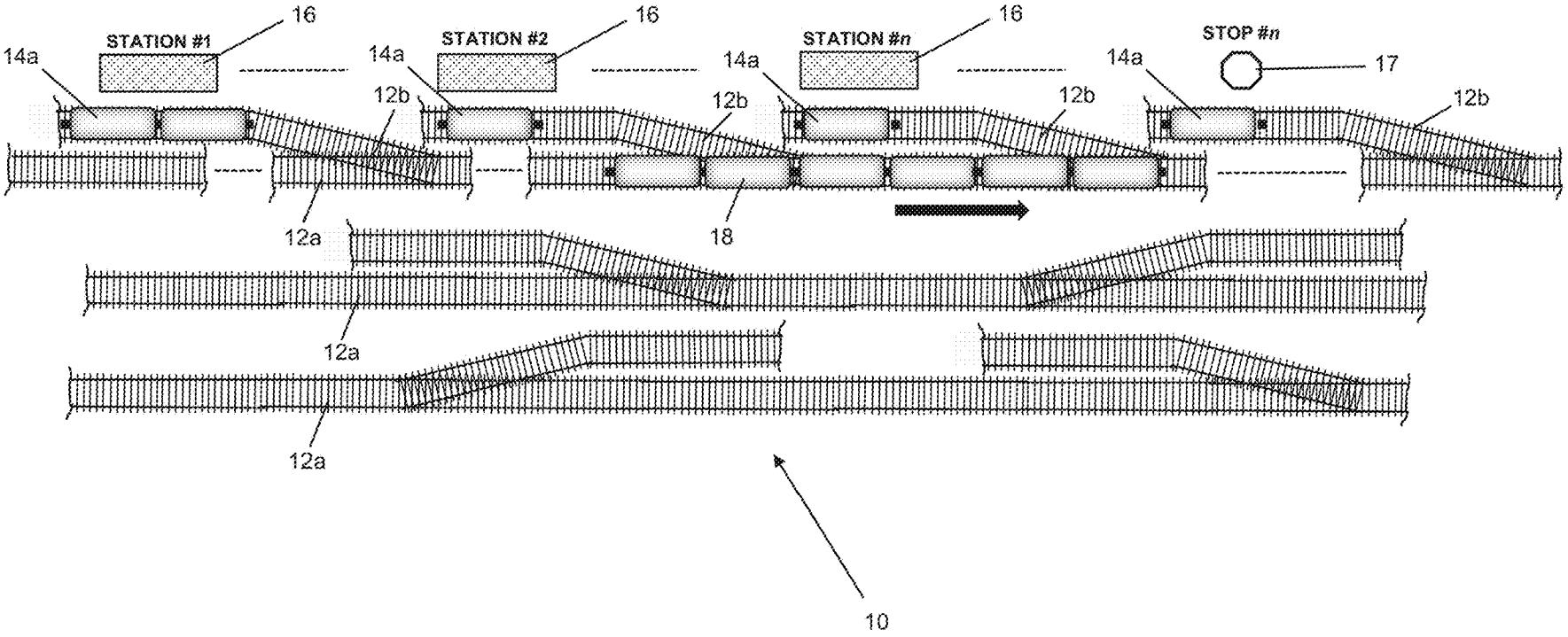
FIG. 2 is a schematic diagram in plan view of an embodiment of the present invention illustrating the initial positioning of the non-stop express train at the first station or stop and the prepositioned train cars located at each station or stop along the route or routes.

FIG. 2 depicts a non-stop train system 10 of the present invention that includes a non-stop express train 18. The non-stop express train 18 runs on a main track 12*a* in either direction and does not have to turn around or cross over to another main track 12*a* to operate. The present invention further includes a plurality of stop tracks 12*b*. Each of the stop tracks 12*b* include an entrance from the main track 12*a* and an exit to the main track 12*a*. Each of the stop tracks 12*b* are a drop off and pickup location 16, 17. The stop tracks 12*b* are located off of any number or series of parallel main tracks 12*a*. Prepositioned express train car 14*a* or cars 14*a*, depending on passenger volume, are stationed at each drop off and pickup location 16, 17 along the existing route. This embodiment has the flexibility to allow for prepositioned cars 14*a* to be anywhere along the route on any one of an unlimited number or series of parallel tracks 12*a* without the requirement to use pre-existing stations 16. Each prepositioned train car 14*a* may uniquely act as a drop off and pickup location 16, 17 . . . n anywhere along the track 12*a*, 12*b* or any number of parallel tracks 12*a*, 12*b* with a safe, climate-controlled environment and with the options of wireless internet access, toilet facilities and food and beverage kiosks. Each prepositioned train car 14*a* has an operator who acts as the conductor while the car 14 is stationary awaiting the non-stop express train 18. The conductor monitors the prepositioned train car 14*a* to ensure passengers are safe. The operator may use a hand-held scanning device, such as used for bar codes, to scan each passenger's ticket to confirm payment. Once all passengers are accounted for and via audio and visual in-car signals, the arrival of the non-stop express train 18 is announced, the access doors on the sides or ends of the prepositioned car 14*a* close and the conductor then becomes the operator and enters the operator's cab and prepares to leave the drop off and pickup locations 16, 17 . . . n once the on-coming non-stop express train 18 has passed this station or location. Each operator's cab, as part of this embodiment, contains a visual display, part of a coupling proximity sensor suite system, indicating the distance and time of arrival of the non-stop express train 18 that is approaching. The prepositioned car 14*a* then uses an audio and visual countdown to accelerate the prepositioned car 14*a* to speed once the non-stop express train has passed by the prepositioned train car or cars 14*a*. The operators of the prepositioned car 14*a* and the non-stop express train 18 are in constant communication via transceivers over wireless networks to ensure coordination of train operations.

Figure 3A:
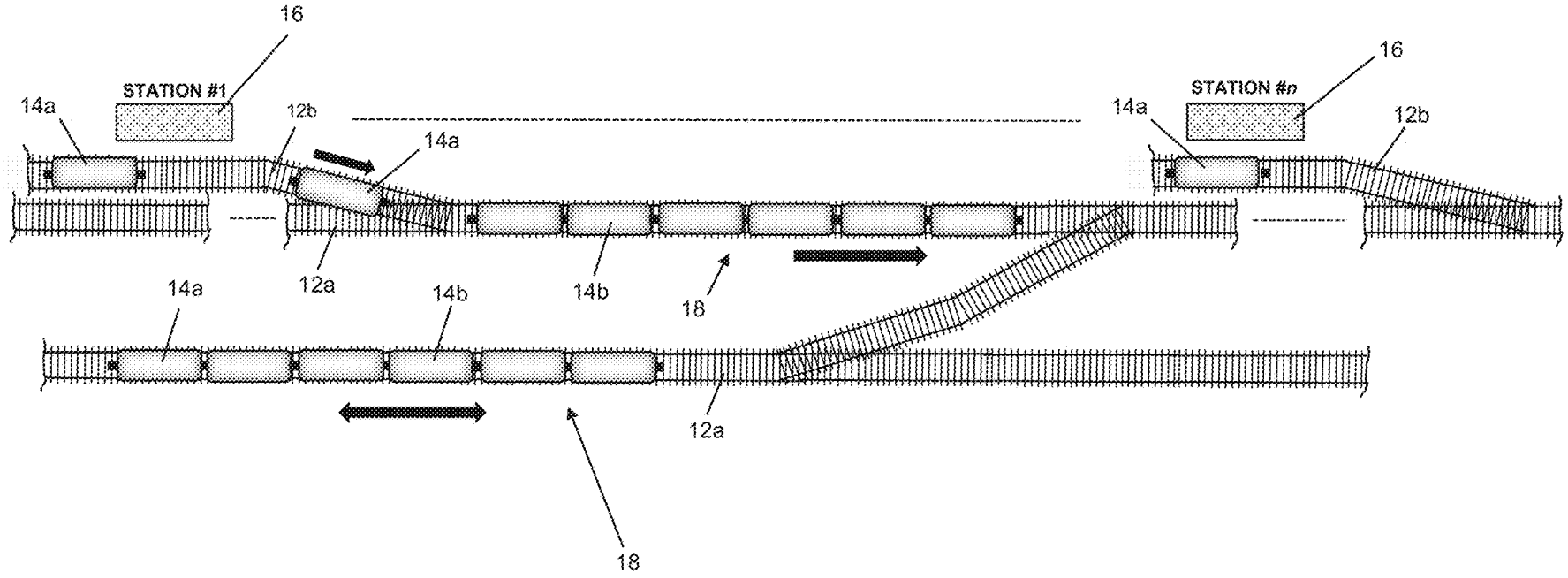
FIG. 3A is a schematic diagram illustrating the movement of the non-stop express train leaving the first station or stop on a track that is parallel to other tracks and proceeding to the next station or stop.
Figure 3B:
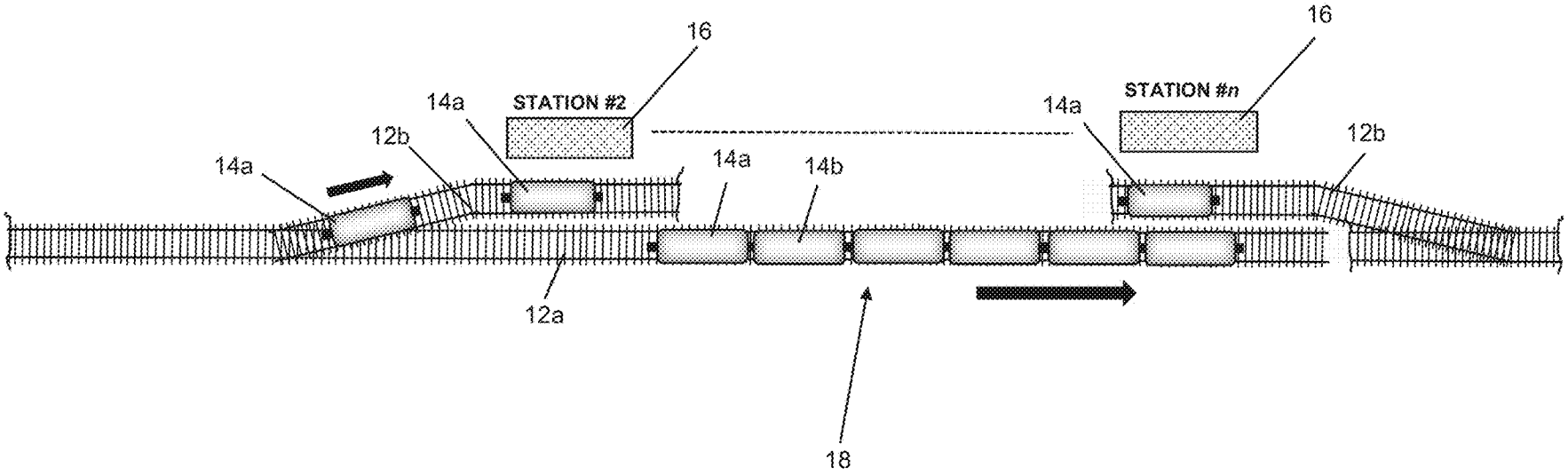
FIG. 3B is a schematic diagram illustrating the train car decoupled from the rear of a non-stop express train and slowing down to come to a stop at the station at a stop track off of the main track.

FIGS. 3A and 3B depict the basic operating cycle of this embodiment wherein the prepositioned train car 14*a* leaves the stop track 12*b*, enters the main track 12*a*, and accelerates to operating speed after the non-stop express train 18 has gone past the drop off and pickup location. The prepositioned train car 14*a* then catches up to the non-stop express train 18 to begin the coupling process. A prepositioned train car 14*a* remains at the first station 16 or stop along the non-stop express train route as a prepositioned car 14*a* for the next scheduled non-stop express train 18 to approach this stop or location. The prepositioned car operator begins the coupling process once the train car 14*a* has caught up and is at the proper speed to couple with the non-stop express train 18. The prepositioned train car 14*a* is now part of the non-stop express train 18. Prior to the next station 16 or stop, the prepositioned car 14*a* attached to the rear of the non-stop express train 18, is now available for passengers to enter to allow them to disembark at the next station 16 or stop along the non-stop express train route. The non-stop express train 18 has any number of drop off car(s) 14*a* and 14*b* which can detach and stop at the next designated station 16 or stop along the non-stop express train route. The drop off car(s) 14*a* and 14*b* that are approaching this aforementioned station 16 or stop enter the stop track 12*b* from the main track 12*a* and decelerate by using braking or, in a further embodiment, using regenerative braking, to come to a stop to act as the replacement propositioned car 14*a* at the designated station 16 or stop to await the arrival of the next non-stop express train 18. At the originating point of the non-stop express train 18, which is the first station 16 or stop on the route, the present invention may include two or more non-stop express trains 18 that are not connected to each other and are on the same or on any number of parallel main tracks 12*a*: each of these non-stop express trains 18 include a variable number of non-stop express cars 14*b*, depending on passenger volume requirements, and may be ahead of, or parallel to, the other non-stop express train(s) 18 depending on the number and layout of the tracks 12*a*, 12*b*. Any number of prepositioned cars 14*a* can remain at the initial station 16 or stop to await the next scheduled non-stop express train(s) 18.

Figure 4:
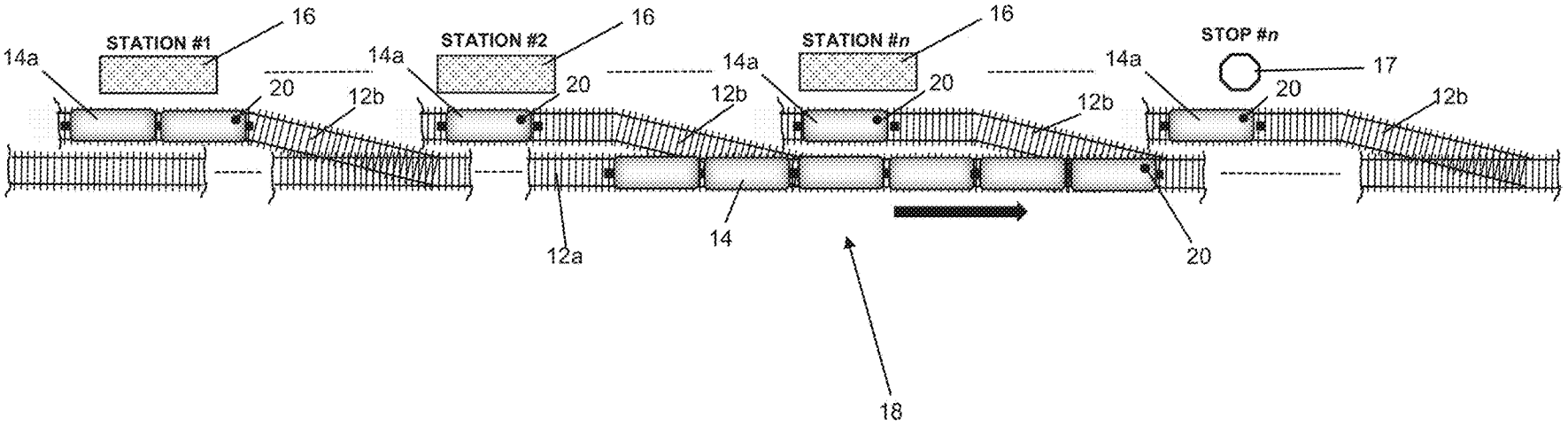
FIG. 4 is a plan view of an embodiment of the present invention illustrating the interiors of the prepositioned train cars and the express train cars depicting the positioning of the train car operators at each station or stop along a train route.

FIG. 4 depicts the interior plan view showing the initial positioning of the train car operators 20 of both the non-stop express train cars 14 on the main track 12*a* and the prepositioned train car 14*a* of the station 16 or stop 17 on the stop track 12*b*. It also depicts the interior plan view of the downstream prepositioned train cars 14*a* showing the initial positioning of the train car operators 20 at the successive station 16 or stop 17 along the route. The express train embodiment includes fully manual operation, manual operation with computer assistance and fully automated, computer-controlled operation of both the non-stop express trains 18 and the prepositioned train cars 14*a* via the coupling proximity sensor suite system. The type of operation is determined by the desired speed of the trains 18, complexity of the routes and the funding available to upfit the existing rail cars 14 with the necessary system and computer hardware. New rail cars 14 can have the desired coupling proximity sensor suite system controls incorporated during construction. The coupling proximity sensor suite system is further described below.

Figure 5:
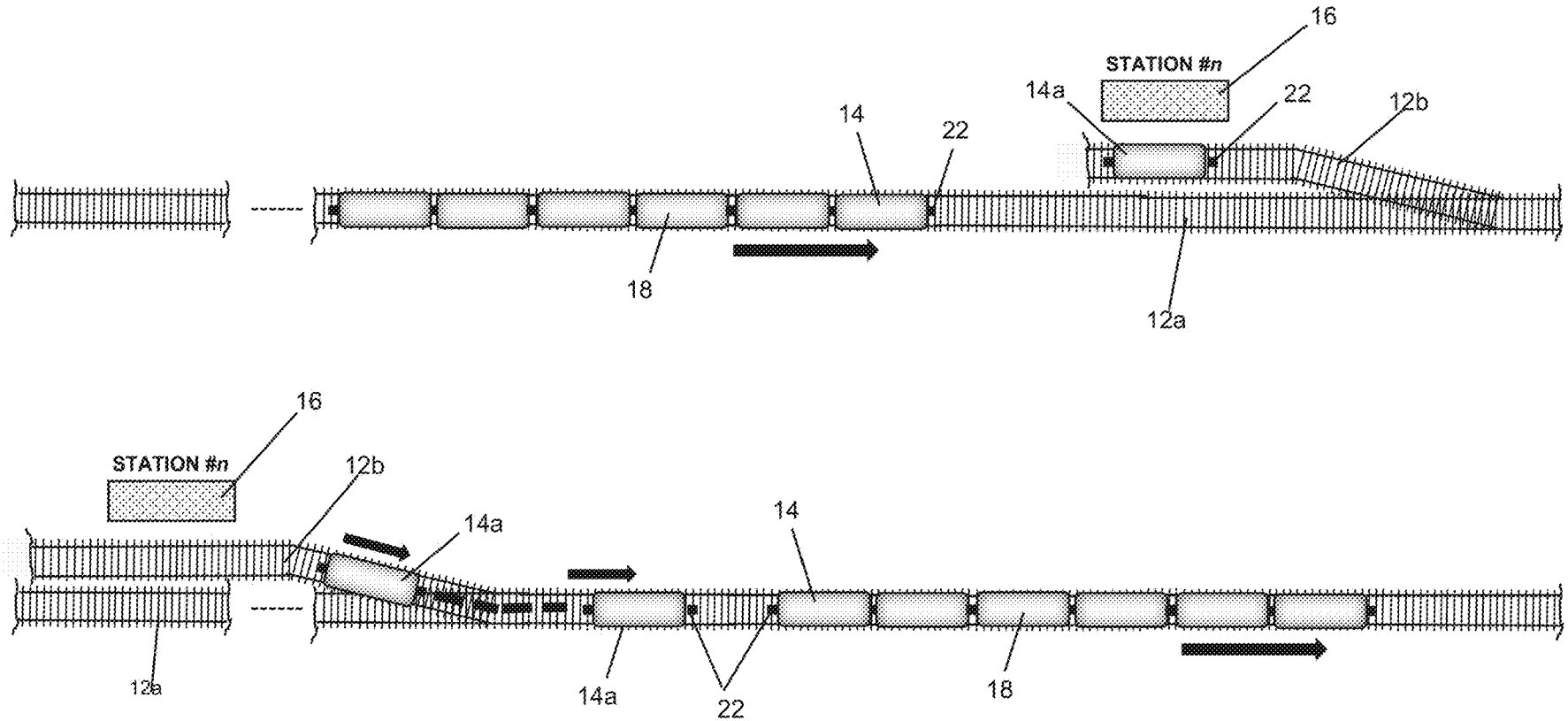
FIG. 5 is a schematic diagram in plan view of an embodiment of the present invention illustrating the express train passing the next station or stop and the prepositioned train car at that station or stop leaving the station or stop after the non-stop express train has passed.

FIG. 5 is a depiction of the operation of the non-stop express train 18 approaching the next station 16 or stop along the route of the main track 12*a* after it leaves either the origination point or any station 16 or stop along the way and shows that the prepositioned train car 14*a* at that the station 16 or stop of the stop track 12*b* before and then after the prepositioned train car 14*a* leaves the station 16 or stop after the non-stop express train 18 has gone by that station 16 or stop. This evolution, again, is coordinated between the operator of the non-stop express train 18 and the operator of the prepositioned car 14*a* via constant wireless network communication and the coupling proximity sensor suite system to ensure safe and efficient operation of the trains 18. The embodiment includes the use of a coupling proximity sensor suite, which is described in more detail below, to allow for a smooth and safe coupling of the mating trains 18 while continuing to use the current art and industry standard Scharfenberg coupler or a coupler of a similar nature or any type of a coupling mechanism 22 that allows for these connections to be made and unmade while the non-stop express trains 18 and individual train cars 14 are underway.

Figure 6:
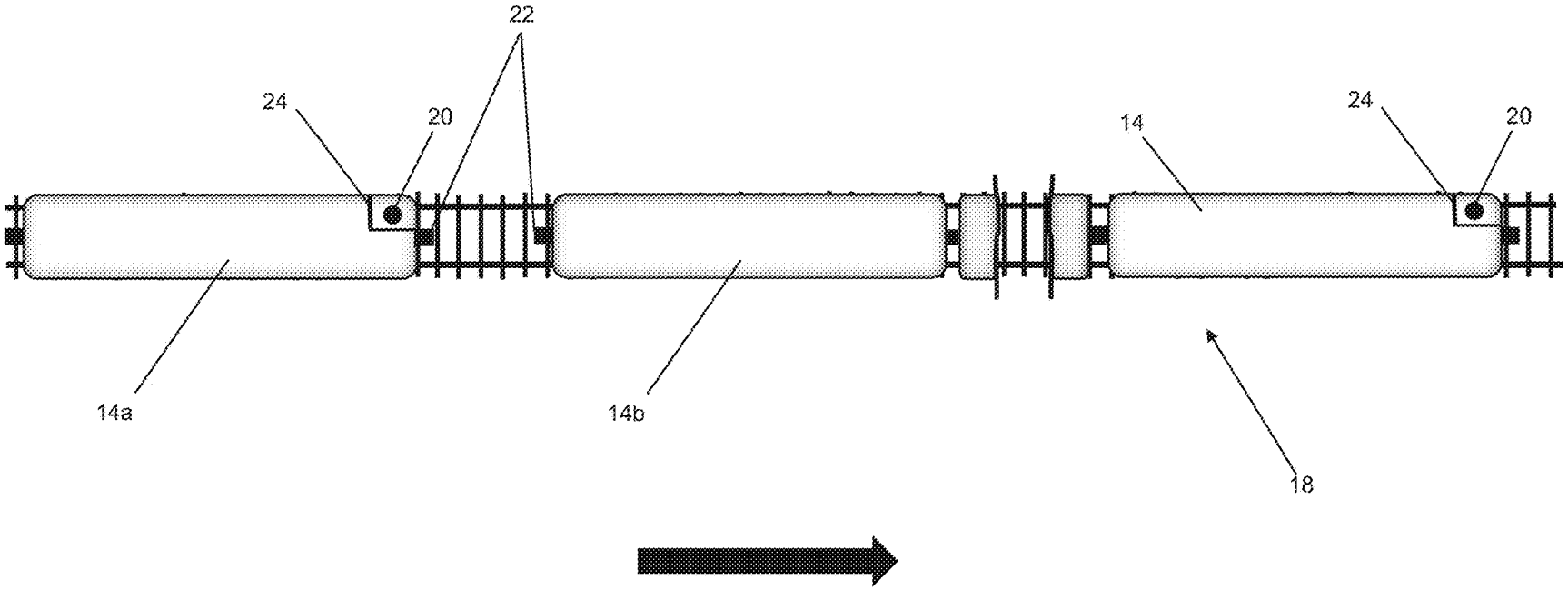
FIG. 6 is a plan view of an embodiment of the present invention illustrating the positioning of the non-stop express train operator and the positioning of the operator of the prepositioned train car that left the station or stop after the non-stop express train passed by and shows the two train cars just prior to coupling.

FIG. 6 depicts the positioning of the train operator 20 of the non-stop express train 18 and the positioning of the operator 20 of the prepositioned train car 14*a* that just left the station or stop and is catching up to the non-stop express train 18. This scenario is prior to coupling of the prepositioned car 14*a* to the rear car 14*b* of the non-stop express train 18. These operators 20 are either fully manually controlling or using partial computer control or fully computerized control of the acceleration, approach, coupling and control synchronization of the prepositioned car 14*a*, which is the car that is attaching to the rear car 14*b* of the non-stop express train 18. The operator 20 of the non-stop express train 18 remains in the operator's cab 24 and monitors the visual indicators that display the status of upcoming coupling operation and the speeds of the train cars 14 and is in constant communication with the operator 20 of the prepositioned car 14*a* behind the non-stop express train 18. The operator 20 of the prepositioned car 14*a* is also monitoring the indicators for train speed and operational status of the couplings 22 and controls of the prepositioned car 14*a* using the displays in the operating cab 24 of the train car 14*a*. The coupling proximity sensor suite system is used for these operations.

Figure 7:
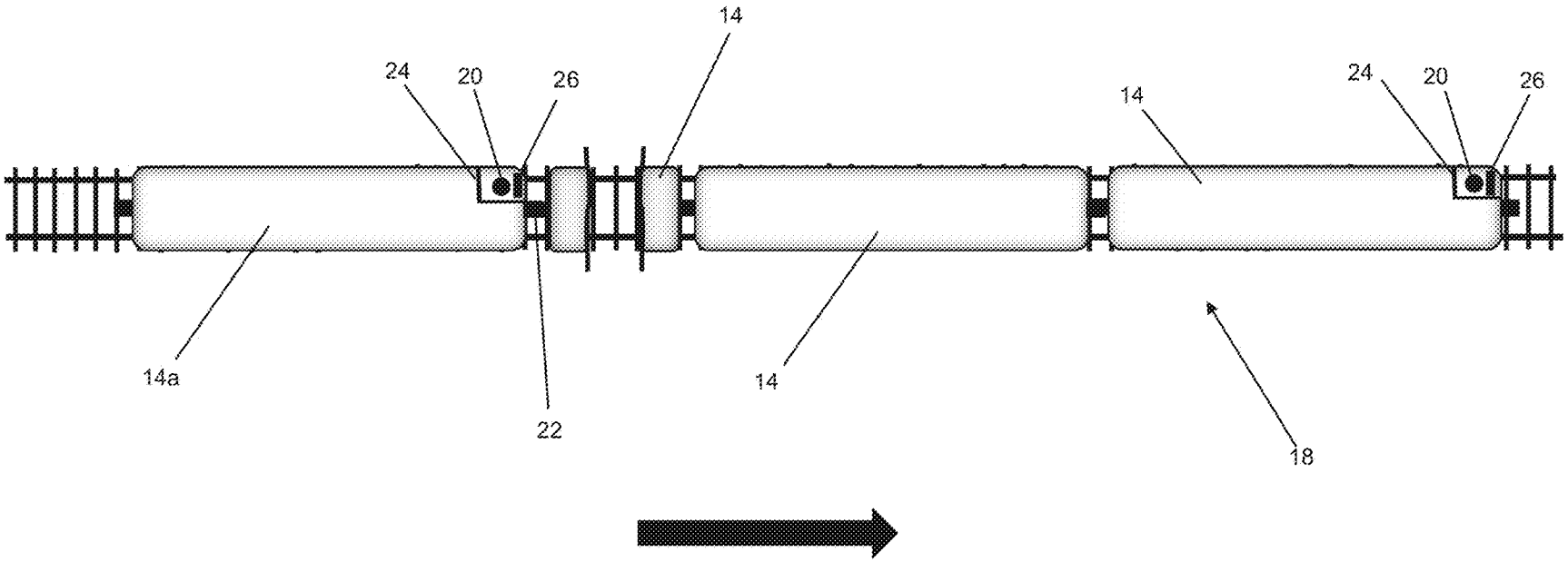
FIG. 7 is a plan view of an embodiment of the present invention illustrating the coupling operation of the prepositioned car behind and the non-stop express train ahead while moving.

FIG. 7 depicts the actual coupling operation of the prepositioned car 14*a* that left the station or stop and is going to be attaching to the rear car 14 of the non-stop express train 18. The coupling of the prepositioned car 14*a* and the non-stop express train 18 while moving uses a coupling mechanism 22 such as existing Scharfenberg couplings or a coupler of a similar nature or any type of coupling mechanism 22 that allows for these connections to be made and unmade while the non-stop express trains and individual train cars 14 are moving, supplemented by the coupling proximity sensor suite system and the associated displays 26 in the connecting cars 14 to aid in safe, coordinated and smooth coupling of the two cars 14 together. The embodiment covers the use of a fully manual, computer-assisted or fully automated coupling proximity sensor suite system to control this coupling evolution while underway. The embodiment uses a common coupling proximity sensor suite system display 26 in the operator cabs 24 of each car 14 to provide the necessary information, instructions, status, warnings and error messages to be used during the actual coupling evolution. This display 26 is the same regardless of whether the coupling operation is fully manual, partially computer-controlled, or a fully automated system. The display 26 shows the coupling status information, confirmation that the cars 14, 14*a* are properly connected together or any error message or messages with corresponding operator action or actions required to correct.

Figure 8:
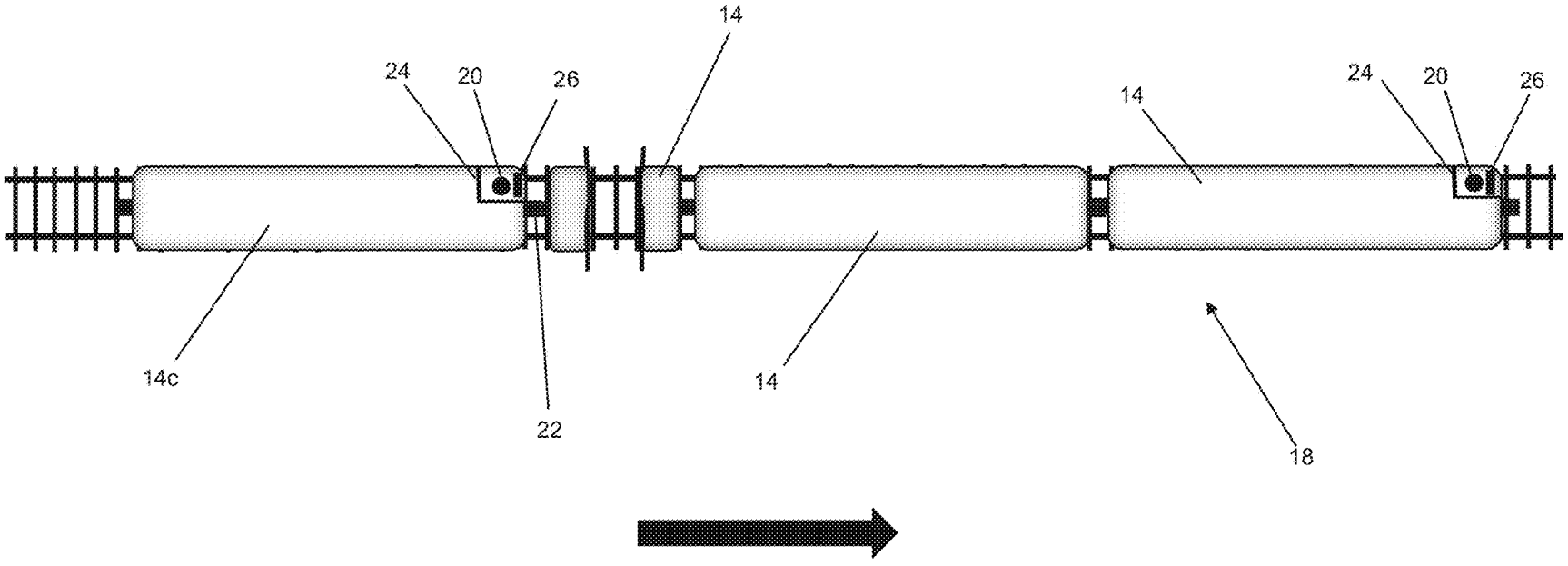
FIG. 8 is a plan view of an embodiment of the present invention illustrating the interiors of the non-stop express train and the prepositioned train car with their respective operators after coupling operation is completed.

FIG. 8 depicts the locations of both the non-stop express train operator 20 in the forward operator cab 24 of the train car 14 that is the lead car of the non-stop express train 18 and the operator 20 of the rear car(s) 14*c* that just attached at the rear of the non-stop express train 18. The operator of the rear car(s) 14*c* that just attached remains in this cab and prepares to detach at the drop off and pickup location that is the next station or stop along the non-stop express train route. The operators 20 of the both the non-stop express train 18 and the soon-to-detach rear car(s) 14*c* remain in their respective operator cabs 24 and monitor the visual display 26 indicators of the coupling proximity sensor suite system that displays the status of the coupling system 22, train speed and the countdown to decoupling operations. The operator 20 of the prepositioned car 14*c* that is now coupled to the rear of the non-stop express train 18 confirms by using the master operating key, master token, master code card or other similar device for the coupling proximity sensor suite system that the system is fully operational and that the drop off car 14*c* is ready to decouple and operate independently prior to the decoupling sequence. The proximity sensor suite system display 26 is also equipped to provide confirmation that the control systems are synchronized and visually displays the rear of the drop off car 14*c* to allow the train car operator to see that the track behind the car 14 is clear. The display 26 also show any error message or messages and what action or actions are required to correct the error or fault with the system.

Figure 9:
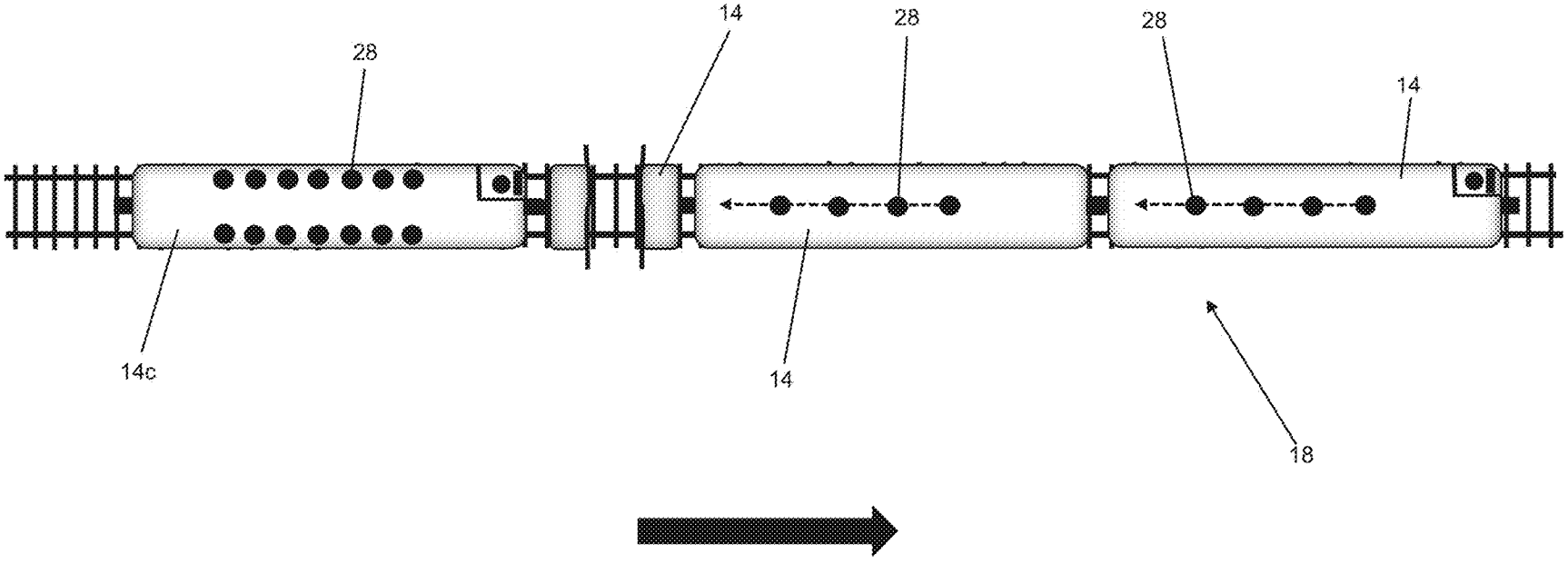
FIG. 9 is a plan view of an embodiment of the present invention illustrating the movement of passengers to the last car or cars of the non-stop express train prior to departure of the last car for the next station or stop along the route.

FIG. 9 depicts the movement of passengers 28 to the drop off car 14*c* of the train 18 prior to departure of the drop off car 14*c* for the station or stop that is coming up. While this Figure shows one drop off car 14*c*, an embodiment covers the potential that multiple drop off cars 14*c* may be used depending on passenger 28 volume requirements at each station or stop. Passengers 28 are instructed by audible signals and visual signboard indicators with the drop off and pickup location information and arrows showing which direction to go in order to be in the correct car 14 prior to disembarkation. No matter where the passengers 28 are in the train 18, these signals, station information and travel direction arrows are prominently displayed. A further embodiment is that those passengers 28 that sign up to receive text message alerts from the transit authority receive notifications on their phone or other smart device when they should move to the drop off car 14*c* and which car 14 to be in in order to disembark at the desired station or stop. Those passengers 28 with hearing or visual impairment can receive instructions via vibration of their personal devices or via their braille-equipped devices.

Figure 10:
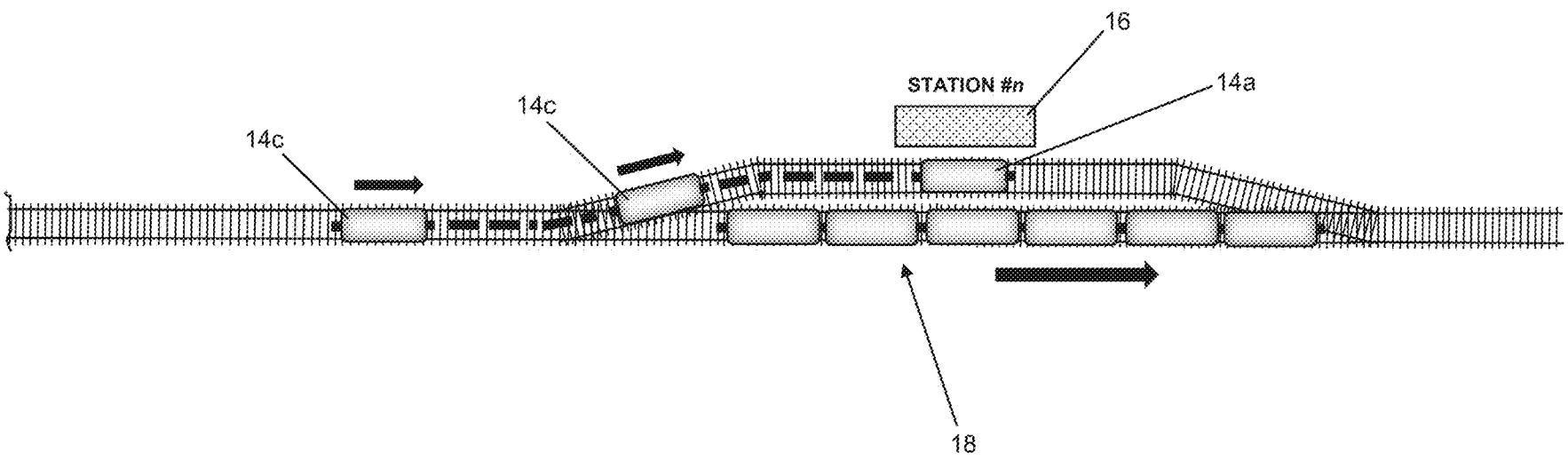
FIG. 10 is a schematic diagram in plan view of an embodiment of the present invention illustrating the rear car of the non-stop express train decoupling from the non-stop express train and stopping at the station or stop that the non-stop express train is in the process of passing.

FIG. 10 depicts a drop off car 14*c* that has decoupled from the non-stop express train 18 to stop at the station 16 or stop that the non-stop express train 18 is in the process of passing by. The coupling proximity sensor suite system and associated displays, previously described, are also used for the decoupling operation of the drop off car(s) 14*c* from the non-stop express train 18 while moving. The coupling system operational status, confirmation of successful decoupling and any error or error messages and corrective action requirements are of a similar nature as those displayed during the earlier coupling operation at the rear of the non-stop express train 18 for this same car 14*c*. The display may include braking instructions and braking operational status for fully manual operation, partial computer-controlled operation or fully automated operation of the detaching car. In a further embodiment, the use of regenerative braking to charge associated batteries, super-capacitors or any other type of energy recovery system, such as hydraulic accumulators may be incorporated. The detached, self-propelled drop off train car(s) 14*c* slows and stops at the designated station 16 or stop and is now a prepositioned car 14*a* that disembarks the current load of passengers and waits for new passengers to embark prior to the expected arrival of the next scheduled non-stop express train 18.

Figure 11:
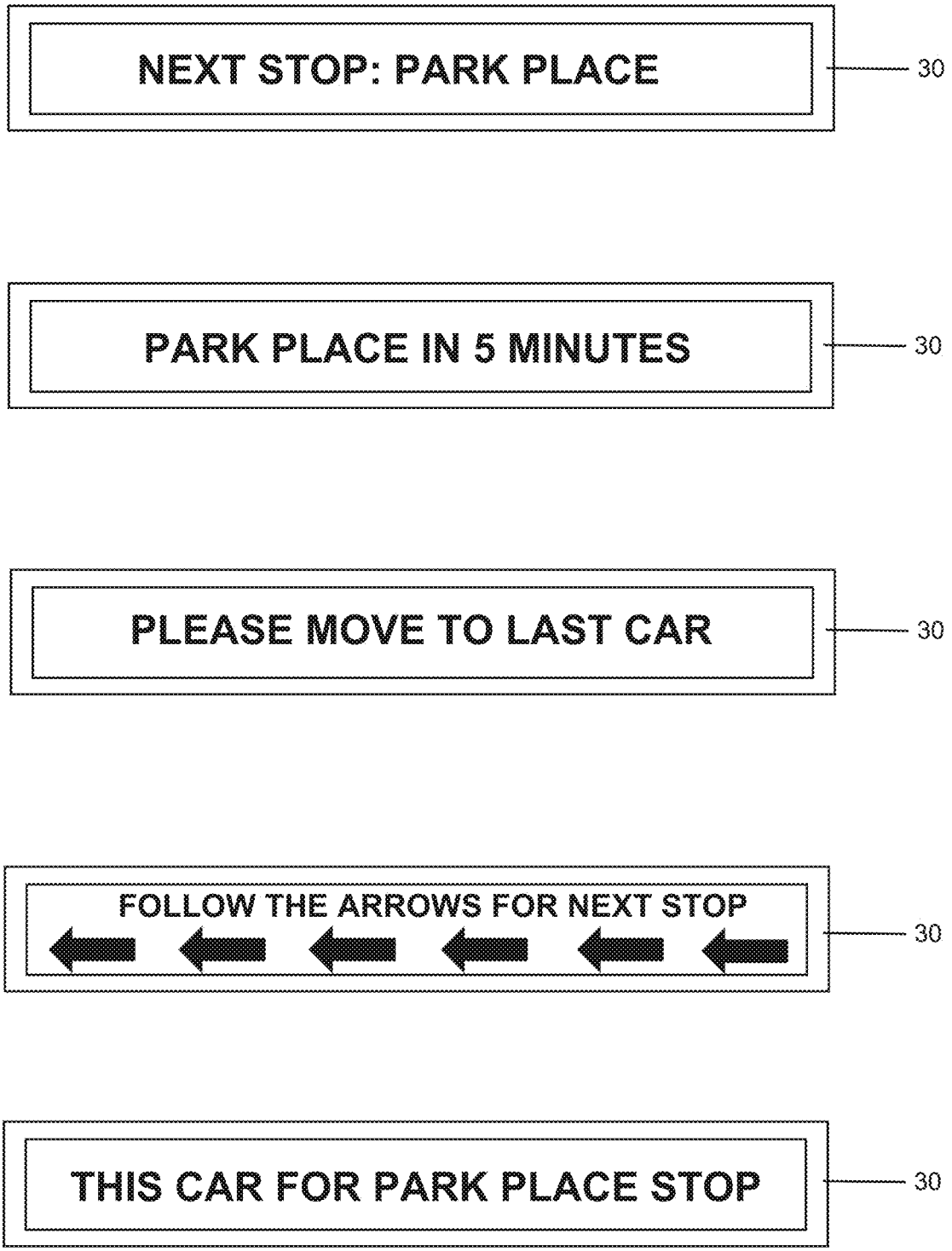
FIG. 11 is an illustration of exemplary visual aids onboard the non-stop express train to inform passengers to move to the last car of the non-stop express train in order to disembark at the next stop.

FIG. 11 depicts the various visual aids 30 that are part of this embodiment on board the non-stop express train to inform passengers about the next stop and which provide instructions for the passengers to move to the drop off car or cars of the non-stop express train in order to disembark at the next stop. These visual aids 30 are graphic displays for the name of the station or stop coming up, the amount of time left prior to arrival at the stop and when to start moving to the drop off car or cars. The visual aids 30 may also include direction arrows that sweep across the display to indicate to the passengers which direction to go in order to get to the correct train car or cars for departure. These direction arrows are displayed in every car in the non-stop express train and efficiently and clearly guide each passenger to the correct car or cars to ensure that the passengers are in the correct car for their stop. The car or cars intended to detach have their visual aids 30 indicating to the departing passengers that they are in the correct car or cars. There are accompanying audible announcements from a speaker system with updates and instructions for the passengers in conjunction with the visual aids 30 to assist the passengers during the departure phase. The visual and audible components of this embodiment may be simple devices or instructions that can be either supplemental devices to the existing car display systems or, depending on the pre-existing equipment in these cars, can be retrofitted into the existing display system.

Figure 12:
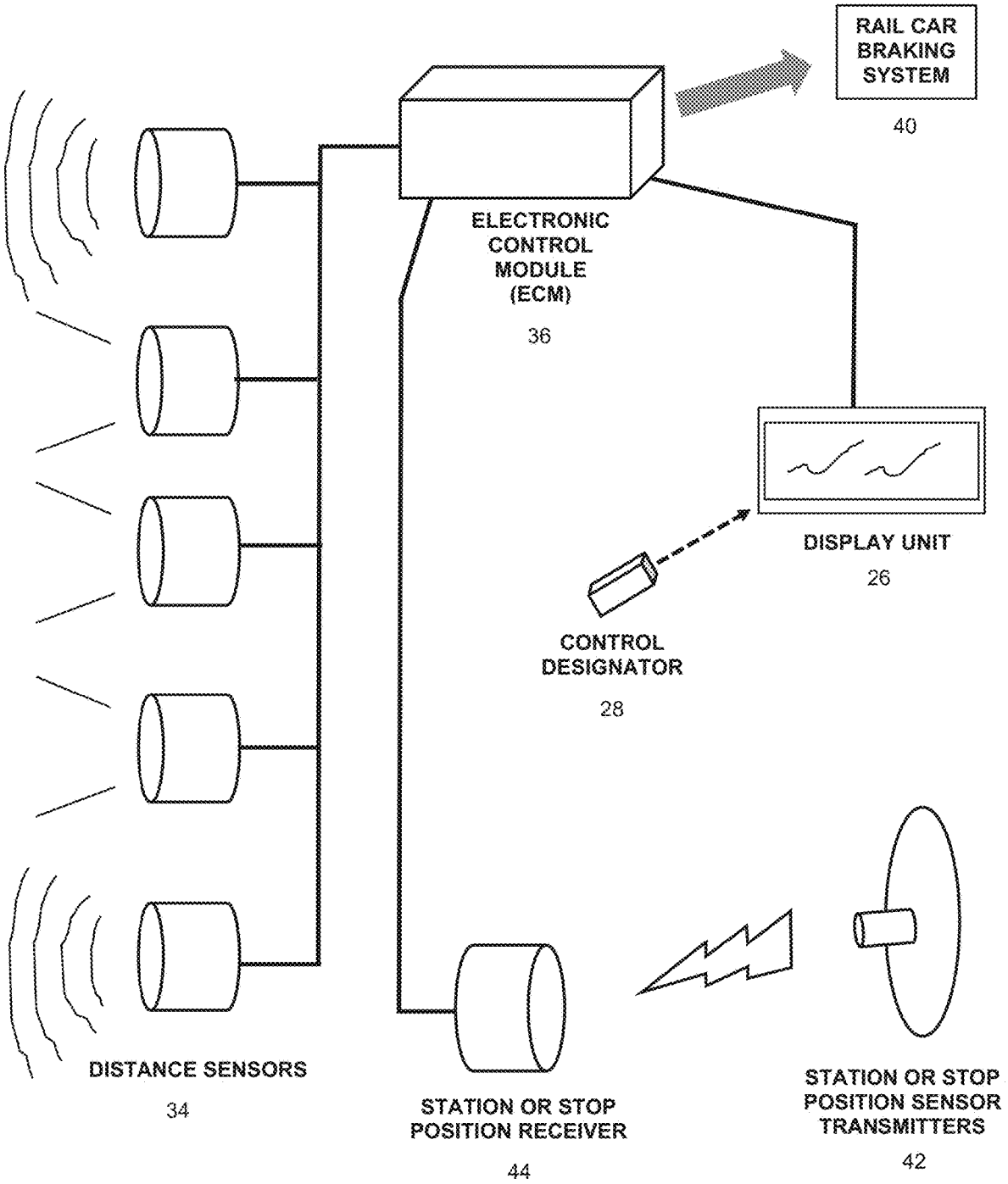
FIG. 12 is a block diagram of an embodiment of the present invention illustrating a proximity sensor suite system used to monitor and control the coupling operations of the railcars while underway.

FIG. 12 is a depiction of the block diagram of the added coupling proximity sensor suite system used to monitor and control the coupling operations of the railcars while underway. The embodiment of this device is composed of the following components:

Distance sensors 34 using various mediums such as radio frequency (radar), sound (sonar or ultrasonic frequencies), visual (cameras or digital computer graphics or computer-generated images (CGI)) or any combination of these devices, or any similar means to provide accurate distance and relative speed information for fully manual, partially computer-controlled or fully automated coupling and uncoupling operations.

In-cab coupling proximity sensor suite system display 26 provides the train operators system status, coupling sensors or switches, speeds, operational instructions, any information or error or warning messages that require corrective action and what that corrective action is for both the coupling and uncoupling operations. The coupling proximity sensor suite system display 26 also includes the camera or CGI views of the couplings showing the distance and relative alignment between the approaching car coupling and the coupling of the car ahead. The display 26 provides real-time targeting information for the operator to monitor using CGI techniques to ensure safe and smooth coupling and decoupling operations regardless of whether the coupling or decoupling operations are either manually or computer controlled.

The coupling proximity sensor suite system electronic control module or ECM 36 uses a central processor unit (CPU) device to receive the inputs from the various sensors, process those inputs and output the appropriate instructions, information, real-time visual, CGI and graphical representations of the coupling equipment status, or provide error messages with the necessary corrective actions required to ensure safe and secure coupling and uncoupling operations. The ECM 36 may also require that a control designator 28 such as the master key, master token, master code card or other similar device be the correct one and is properly inserted in the coupling proximity sensor suite system display 26 in order to properly operate the system for safe coupling and uncoupling of the cars.

Interface with the existing braking system 40 or regenerative braking system to ensure safe and smoothly controlled braking of the detached car such that the car is accurately positioned to come to a stop at the correct location at the designated stop. A position transmitter(s) 42 is permanently installed at each station or stop along the route that transmits a signal to a receiver 44 on each train car that is part of the coupling proximity sensor suite system. That receiver 44 sends the signal as an input to the coupling proximity sensor suite system ECM 36. The ECM 36 then provides the operator of the detached car real-time car-to-station distance information on the display device 26 from the position transmitter(s) 42 in order for the operator to know when to start braking the detached car and to arrive at the correct location at the drop off or pick up location.

Figure 13:
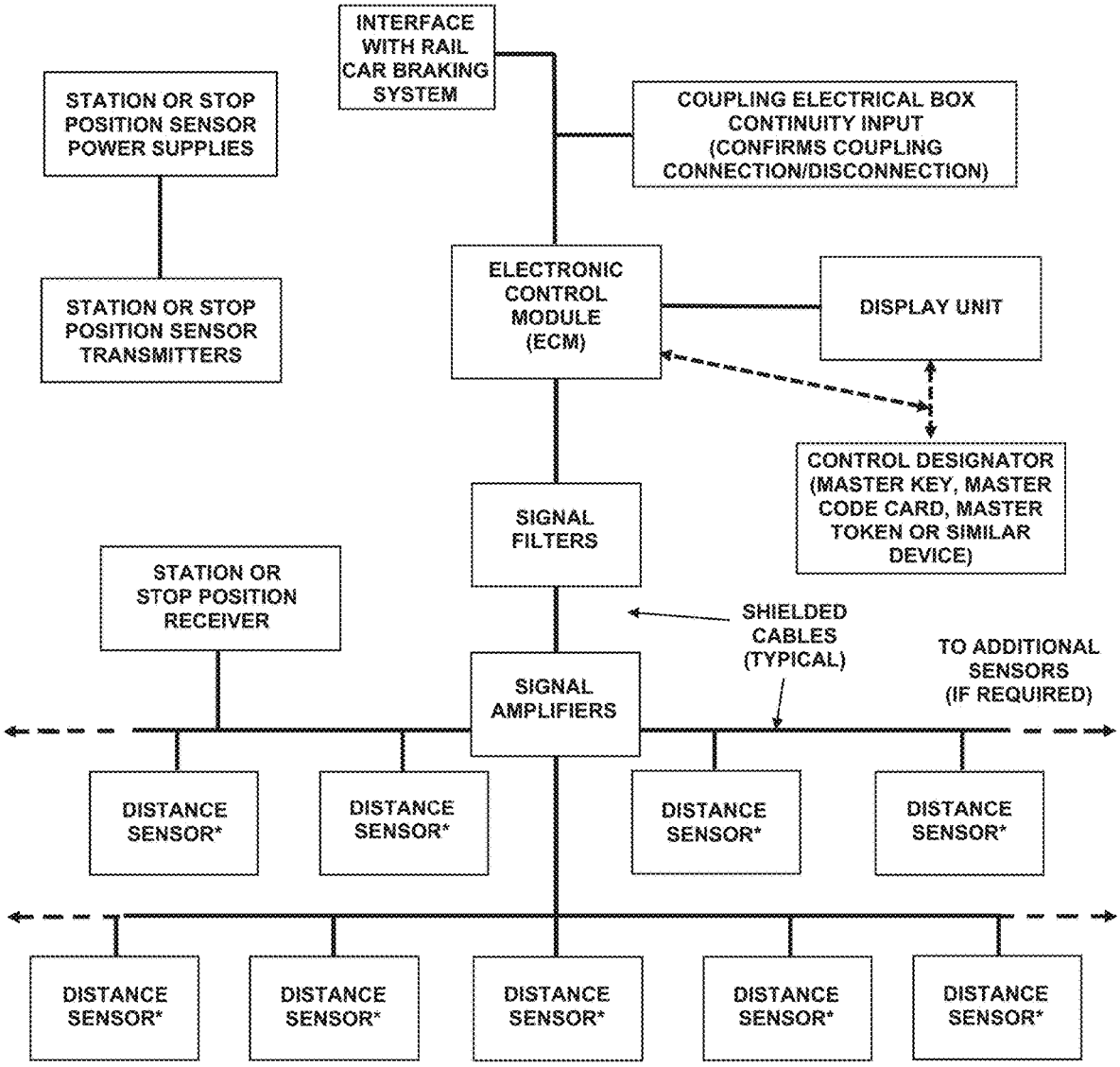
FIG. 13 a block diagram of an embodiment of the present invention illustrating a proximity sensor suite system.

FIG. 13 depicts the line diagram of the added instrumentation and controls for the coupling proximity sensor suite system previously described as part of this embodiment. The entire coupling proximity sensor suite system is anticipated to be a self-contained, pre-assembled module consisting of sensors, receivers, wiring, ECM and display that is easily retrofitted to existing train cars or easily incorporated during fabrication of new train cars. However, the embodiment also includes the suite as individual components that can be incorporated piecemeal. The added coupling proximity sensor suite system wiring connection between each train car is anticipated to be incorporated into the electronics and power box located above each Scharfenberg or similar coupling that is used on virtually all non-stop express train cars.

Figure 14:
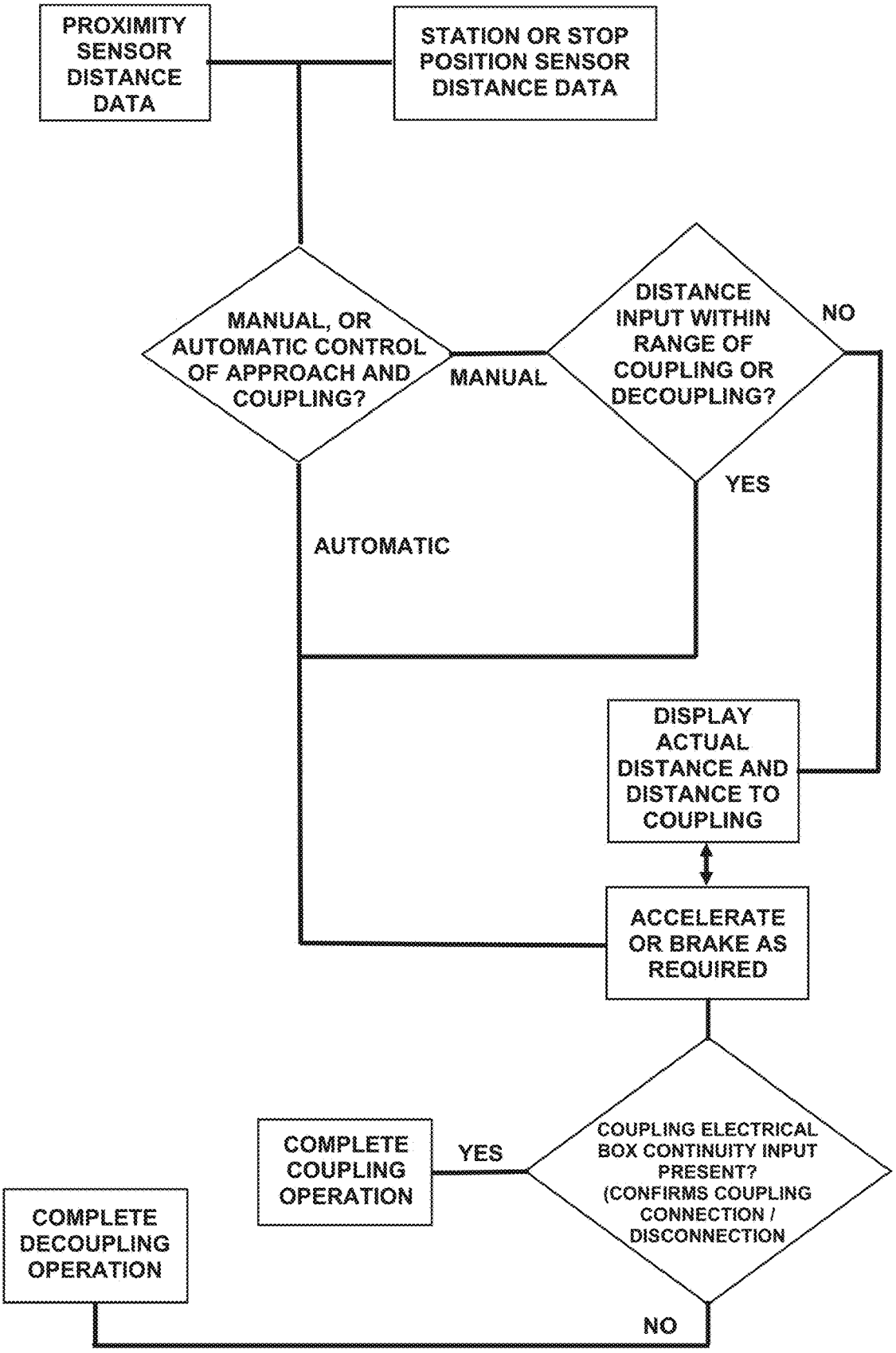
FIG. 14 a block diagram of an embodiment of the present invention illustrating a proximity sensor suite system.

FIG. 14 depicts the coupling proximity sensor suite system logic diagram. The logic diagram is only a basic representation of the decision logic based on the various inputs, variances from the expected input signals, output signals, graphical and visual interfaces, warnings, errors and corrective actions. The system display is haptic based and is heavily graphically and visually based in order to provide the operator with simple, clear and user-friendly information, instructions, warnings, error and corrective action messages. As described in FIG. 12, the system ECM receives input signals from the proximity sensors and position transmitters. These sensors are located at each end of the train car since the car can be coupled or decoupled at either end in this embodiment. The ECM also receives an input signal from fixed transmitters along the route for enabling detached cars to brake and stop at each station or stop. The logic of the system is designed to provide visual instructions, visual information from the cameras and sensors, along with audible and graphical illustrations, graphical notifications, warnings, error messages and the proper corrective action(s). This is all incorporated into the CPU software and an additional feature of this embodiment is that such software can be automatically or manually updated via wireless transmissions from a central service provider when required without disrupting the normal operation of the system.

Figure 15:
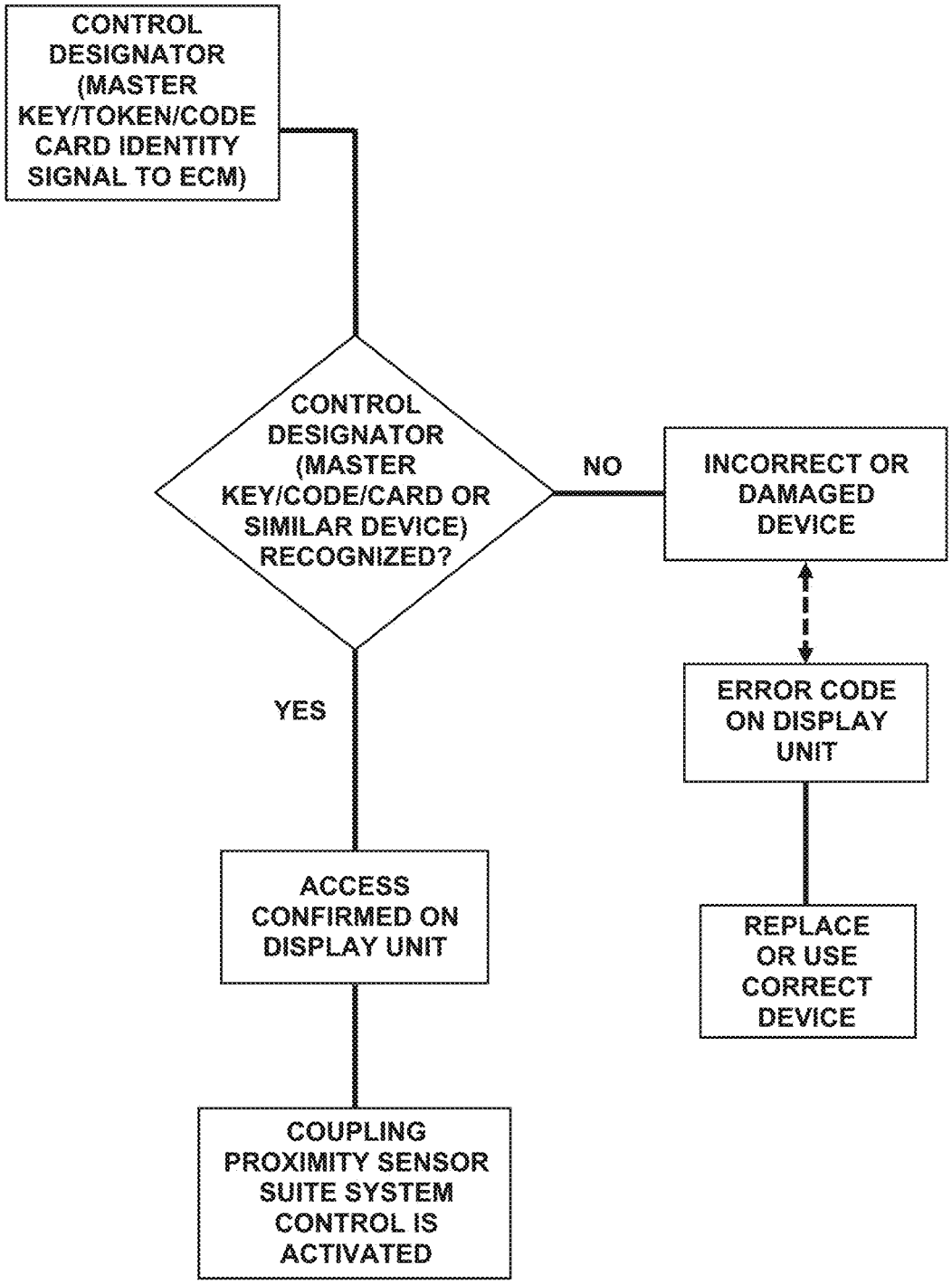
FIG. 15 a block diagram of an embodiment of the present invention illustrating a proximity sensor suite system.

FIG. 15 depicts a simple logic diagram of the control designator, which may be, but is not limited to, a master operating key, master token or master code card that is used as part of this embodiment to initiate operation of the system, transfer operating control to other cars and discontinue operation of the coupling proximity sensor suite system and hence, to provide master control of the non-stop express trains and the individual prepositioned cars. This embodiment covers the use of rolling codes, fixed codes, bar coded, Radio Frequency Identification (RFI) technology or other similar digital device or devices that interface with a corresponding compatible device or devices in the proximity sensor suite system that securely reads the digital codes, confirms correct identity and authorizes user interface and subsequent system operation.

The present invention may further include additional amenities that are included in this embodiment and are proposed for enhancing the non-stop express train experience for passengers. These amenities include, but are not limited to, toilet and washroom facilities, food and non-alcoholic beverage kiosks or set-ups and wireless internet and music access.

The embodiments of this invention as described herein are designed to cost-effectively improve the operation of non-stop express train systems through the use of non-stop express trains that never have to stop at any station or stop along the route to embark or disembark passengers. This train runs continuously thereby providing passengers with the fastest transit possible. The prepositioned cars that are part of this embodiment are used to make the intermediate stops and, as a further aspect of this embodiment, these prepositioned cars take the place of fixed stations and are designed to stop anywhere along the route or routes while acting as the station when stationary at that stop prior to leaving after the passing by of the next non-stop express train. In a further embodiment, the coupling proximity sensor suite system enables the safe, smooth and efficient operation of the coupling and decoupling evolutions of the non-stop express trains and the trailing train cars that attach and separate from the non-stop express trains at each predetermined stop along the route. The invention is further enhanced by the embodiment of the ability to selectively incorporate some or all of the features of this invention depending on budgetary constraints and existing system infrastructure and operating restraints. The embodiment of the coupling proximity sensor suite system that makes this invention possible is further enhanced by it being envisioned as either modular or non-modular in configuration. This aspect of the coupling proximity sensor suite system is another cost-effective approach of this invention, such that existing or new construction train cars can be efficiently outfitted with this system with minimal impact to the budget and can be easily coordinated for installation with the existing rail car maintenance or new car construction schedule.

It should be understood, of course, that the foregoing relates to exemplary embodiments of the invention and that modifications may be made without departing from the spirit and scope of the invention as set forth in the following claims.

What is claimed is:

1. A non-stop train system comprising:

a plurality of train cars each comprising:
- rail wheels;
- a braking system coupled to the rail wheels;
- an operator's cab;
- a display and controllers disposed within the operator's cab;
- a front coupler and a rear coupler;
- a proximity sensor; and
- a wireless transceiver;

an electronic control module communicatively coupled to the proximity sensor and the display via the wireless transceiver of each of the plurality of train cars, the electronic control module comprising a processor and a memory, and at least one main track and a plurality of stop tracks connected to the at least one main track, wherein each of the plurality of stop tracks are a drop off and pick up location, wherein at least one prepositioned train car of the plurality of train cars is configured to be stopped on one of the plurality of stop tracks, at least one non-stop express train car of the plurality of train cars is configured to approach and pass the one of the plurality of stop tracks along the main track, wherein the at least one prepositioned train car is configured to depart from the one of the plurality of stop tracks, the at least one prepositioned train car is configured to accelerate onto the main track from the at least one of the plurality of stop tracks and approach a rear of the at least one non-stop express train car, the proximity sensor of at least one of the at least one prepositioned train car and the at least one non-stop express train car is configured to detect a relative distance and a relative speed of the at least one non-stop express train car and the at least one prepositioned train car, and the electronic control module is configured to process inputs of the proximity sensor and output data comprising the relative distance and the relative speed of the at least one non-stop express train car and the at least one prepositioned train car on the display of at least one of the at least one prepositioned train car and the at least one non-stop express train car to facilitate manual coupling, automated coupling, or a combination thereof of the rear coupler of the at least one non-stop express train car to the front coupler of the at least one prepositioned train car while moving along the main track.

2. The non-stop train system of claim 1, wherein at least one drop off train car is configured to decouple from the at least one non-stop express train car, the at least one drop off train car is configured to enter another of the plurality of stop tracks from the main track, and the braking system of the at least one drop off train car is configured to stop the at least one drop off train car at the another of the plurality of stop tracks.

3. The non-stop train system of claim 2, wherein the electronic control module is further configured to render braking instructions and a braking operational status on the display of the drop off train.

4. The non-stop train system of claim 2, wherein each of the plurality of train cars further comprise at least one of a speaker and a visual aid configured to communicate instructions to passengers.

5. The non-stop train system of claim 4, wherein the visual aids are graphic displays that display a name of an upcoming drop off and pick up location, an amount of time left prior to arrival at the upcoming drop off and pick up location, and when to start moving to the drop off car.

6. The non-stop train system of claim 1, wherein the plurality of drop off and pick up locations comprise a combination of stations and designated stops at the plurality of stop tracks.

7. The non-stop train system of claim 1, wherein the electronic control module further processes and outputs additional data on the display of the at least one of the at least one prepositioned train car and the at least one non-stop express train car, the additional data comprising: a status of the coupling operation; a status of the control of the train cars and a confirmation that the train cars are properly connected together or an error message that provides instructions required to correct the coupling operation.

8. The non-stop train system of claim 1, wherein the electronic control module is further configured to render a distance and a time of arrival of the at least non-stop express train that is approaching from behind the at least one prepositioned car on the display of at least the at least one prepositioned train car and a countdown indicating when the at least one prepositioned car is to start moving to catch up to the at least one non-stop express train.

9. The non-stop train system of claim 1, wherein the front couplers and the rear couplers are Scharfenberg-type couplers.

10. The non-stop train system of claim 1, wherein the electronic control module is further configured to adjust a speed differential of the at least one non-stop express train and the at least one prepositioned car to be between about 0.37 miles per hour up to about 22 miles per hour.

11. The non-stop train system of claim 1, wherein the proximity sensor of the at least one of the at least one prepositioned train car and the at least one non-stop express train car is further configured to detect an alignment of the rear coupler of the at least one non-stop express train car and the front coupler of the at least one prepositioned train car, wherein the electronic control module is configured to render a status of the alignment on the display of the at least one of the at least one prepositioned train car and the at least one non-stop express train car.

12. The non-stop train system of claim 1, wherein the proximity sensor comprises at least one of a radio frequency sensor, a sonar sensor, an ultrasonic frequency sensor, and a camera.

13. The non-stop train system of claim 12, wherein the electronic control module is configured to render real-time visual or graphical representations of the front coupler and the rear coupler on the display of the at least one of the at least one prepositioned train car and the at least one non-stop express train car.

14. The non-stop train system of claim 1, wherein the electronic control module is configured to designate a control car to control the train via a control designator, wherein the control designator is transferable from the non-stop express train car to another connected car and the prepositioned train car has its own control when the prepositioned train car is coupled to the at least one non-stop express train car, wherein the control designator is at least one of a master key, a master token, a master code, and a master computer readable code.

* * * * *